US005431583A

United States Patent [19]

Szegda

[11] Patent Number: 5,431,583

[45] Date of Patent: Jul. 11, 1995

[54] WEATHER SEALED MALE SPLICE ADAPTOR

[75] Inventor: Andrew Szegda, Canastota, N.Y.

[73] Assignee: John Mezzalingua Assoc. Inc., Manlius, N.Y.

[21] Appl. No.: 185,706

[22] Filed: Jan. 24, 1994

[51] Int. Cl.[6] ..... H01R 13/40

[52] U.S. Cl. ..... 439/589; 439/587

[58] Field of Search ..... 439/587, 589

[56] References Cited

U.S. PATENT DOCUMENTS

| | | | |
|---|---|---|---|
| 3,904,264 | 9/1975 | Oertle | 439/587 |
| 4,032,210 | 6/1977 | Vogt | 439/393 |
| 4,501,927 | 2/1985 | Sievert | 174/93 |
| 4,673,233 | 6/1987 | Hertelendy | 439/442 |
| 4,685,764 | 8/1987 | Hoffer | 174/93 |
| 4,743,209 | 5/1988 | Gittle | 439/521 |
| 4,797,122 | 1/1989 | Kuboi et al. | 439/589 |
| 4,857,672 | 8/1989 | Rebers | 174/93 |
| 4,879,807 | 11/1989 | Roucaute | 29/828 |
| 5,183,413 | 2/1993 | Lazardo, Jr. et al. | 439/587 |

*Primary Examiner*—Mark Rosenbaum
*Assistant Examiner*—Jeffrey T. Knapp
*Attorney, Agent, or Firm*—Samuels, Gauthier & Stevens

[57] ABSTRACT

A male splice adaptor includes a tubular housing having first and second sections which are detachably coupled to one another. Each of the sections includes an output port from which a connector pin extends from within the housing. A seal is provided in each of the output ports and is configured so that as the first and second sections are coupled to one another, the seal is expanded so as to create a weather-tight seal within the output port.

24 Claims, 2 Drawing Sheets

WEATHER SEALED MALE SPLICE ADAPTOR

BACKGROUND OF THE INVENTION

The invention relates to splice adaptors used in the cable television or telecommunications industry.

Various electronic equipment are utilized in the television and telecommunication transmission systems. When two or more pieces of equipment are joined together, a splice is created. Generally, the splice should be enclosed, for protection from the environment. For example, if the closure is an aerial closure, used with aerially suspended equipment, protection against damaging interference from weather elements, and so forth may be necessary or desired.

The devices which are adapted for coupling equipment together are referred to as splice adaptors. Such devices are conventionally configured to physically and electronically couple equipment to one another without the use of cable and the associated connectors. The splice adaptors can include an elongate, typically cylindrical, casing having first and second coupling ports. It is generally desirable that seals be provided at the coupling ports in order to ensure an environmental seal for the adaptor.

Unfortunately, conventional male splice adaptors, which typically include a center pin extending through opposite ports of a housing, fail to provide weather-tight environmental seals which prevent moisture from entering the adaptor housing and possibly flowing through to the attached equipment. Under certain conditions, the moisture within an adaptor housing turns into a vapor, after which pressure builds within the housing, thus forcing a migration of the moisture through the housing and into the attached equipment.

Conventional male splice adaptors do not provide for adequate weather-tight sealing at the coupling ports. Usually the male adaptors include o-rings used at the coupling ports to seal provide a seal from the outside environment. However, this type of seal ignores the need to seal the housing within the coupling port. The o-rings alone tend to be ineffective due to the equipment on either side of the adaptor needing maintenance or repair. In these situations, the equipment covers are opened and closed possibly causing damage to the weather seals associated with the equipment housings. Accordingly, if moisture invades the interior of the equipment housing, it inevitably leads to the moisture migration problems discussed above.

At this point only spacing disks within the coupling port, which are primarily used for supporting the connecting pin within the adaptor housing, are the only deterrent to moisture migration along the adaptor pin. However, the spacing disks provide little or no weather-proof sealing.

It is therefore an object of the present invention to provide a male splice adaptor with a weather-tight seal provided at each coupling port, thus providing a longitudinal seal along the length of the adaptor pin.

SUMMARY OF THE INVENTION

A male splice adaptor including a tubular housing having a first section which is detachably coupled to a second section, the first section including an output port. A connector pin is disposed within the housing and extends outwardly from the output ports. A seal is provided in each of the output ports and is configured such that the connector pin passes through the seal to extend from the output port. Means are associated with the output port for retaining this seal within the output port. Means are associated with the connector pin for coacting with said retainer means in response to the coupling of said first section to said second section to distort said seal in a manner creating a weather-tight seal between said pin and said first section within said output port.

DETAILED DESCRIPTION OF THE ILLUSTRATED EMBODIMENTS

Figures 1, 3:
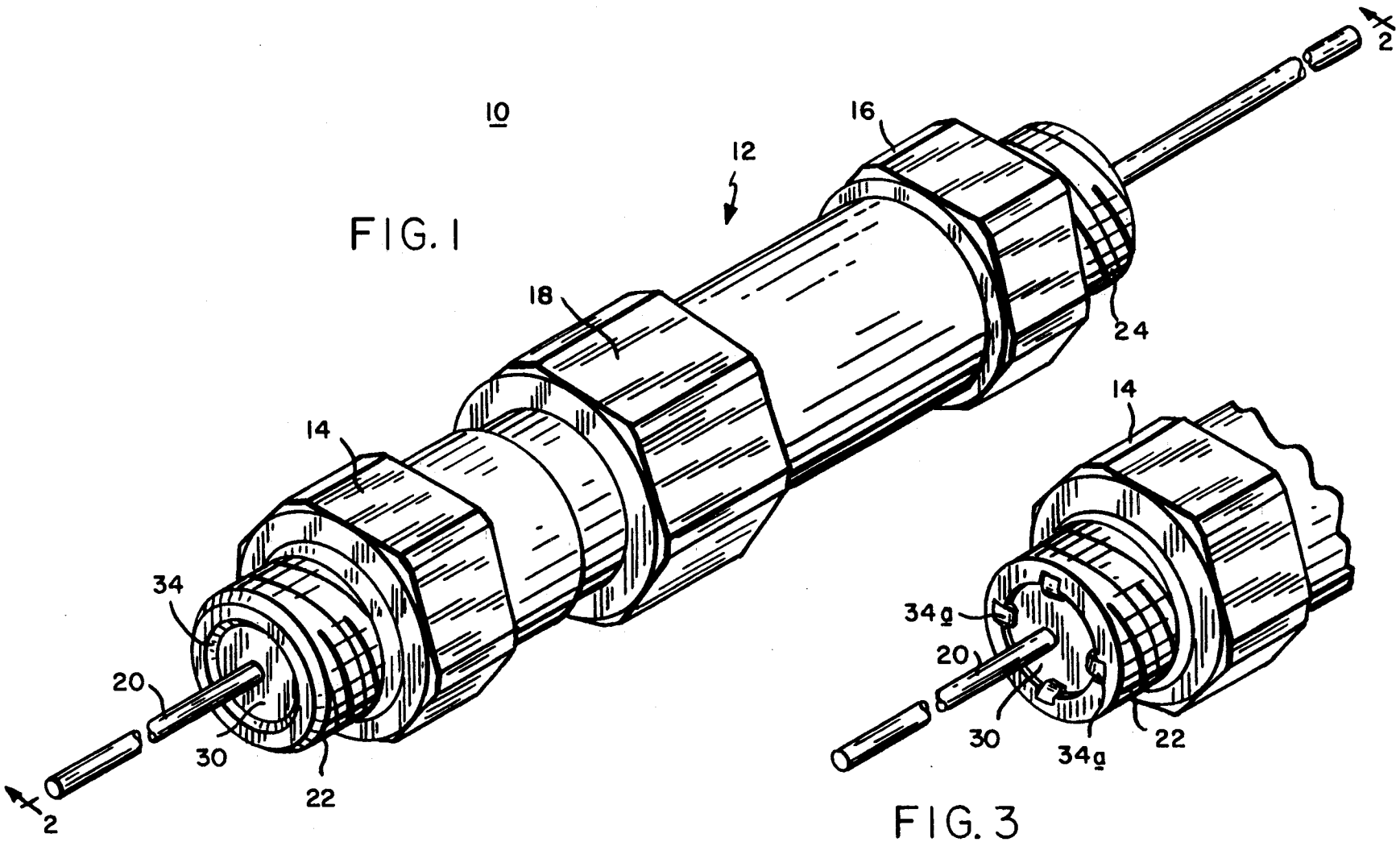
FIG. 1 shows a perspective view of the male splice adaptor in accordance with the present invention.
FIG. 3 shows a perspective view similar to that of FIG. 1, featuring the use of retaining tabs instead of the curled sealing end shown in FIG. 1.
Figure 2:
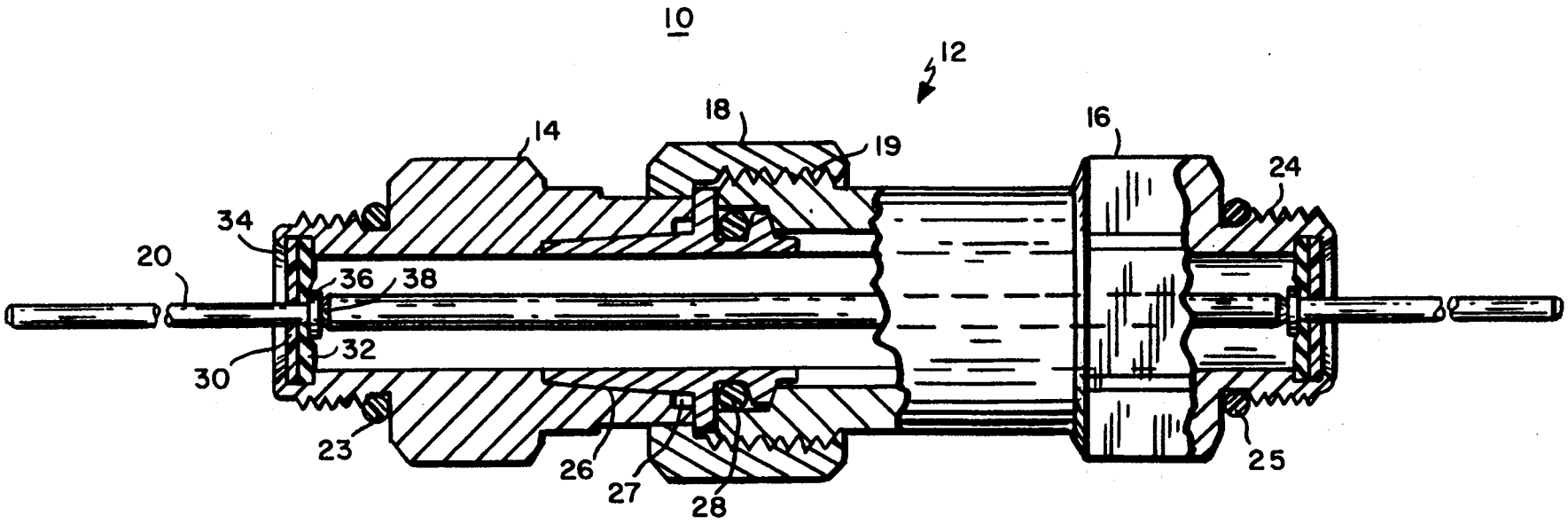
FIG. 2 shows a cross sectional view of the adaptor in FIG. 1 taken along lines 2—2.

With reference now to both FIGS. 1 and 2, a male splice adaptor 10 is shown. The adaptor 10 includes a tubular body 12, preferably of a metallic material. The body 12 includes a first section having a hex nut configuration 14 and a second section also having a hex nut configuration 16. A coupling nut 18 rotatably supported on one end of the first section is used to couple the first and second sections together when it is threadingly engaged with a threaded end of 19 of the second section.

A pin connector 20 is disposed within a chamber 21 formed by the first and second sections of the housing 12. The pin connector extends outwardly from the first section through a coupling port 22, and in turn extends outwardly from the second section from a coupling port 24. O-rings 23, 25 are utilized with the threaded portion of the coupling ports.

The first section includes an insert 26 which serves to rotatably support the coupling nut 18 to the first section. O-rings 27 and 28 are provided with the insert to enhance a weather seal about the coupling nut.

In accordance with the present invention, the openings associated with the coupling ports 22 and 24 are provided with a rigid non-conductive insulator disk 30 having one surface facing outward from the coupling port, and a resilient sealing disk 32 disposed adjacent to the inside surface of the insulator disk. The inside edge surface of the coupling ports are provided with a curled sealing end 34 which serves to support and retain both the insulator disk and sealing disk 32 within each opening of the coupling ports. Alternatively, as seen in FIG. 3, the inside edge surface of the coupling ports may be provided with retaining tabs 34*a* to support and retain the disks.

The connecting pin 20 is configured with a smaller diameter which tapers at a portion 38 to a larger diameter within the chamber 21 of the housing 12. The tapered portion 38 serves to support a compression disk 36 which abuts the inner surface of the sealing disk 32. In operation, as the coupling nut 18 is tightened so as to draw the first and second sections together along the axis of the connecting pin, the compression disk 36 applies an outwardly directed force to the inside surface of the sealing disk 32. This force opposes the force created on the outside surface of the disk 32 by the retaining tabs 34 and insulator disk 30. Accordingly, as the first and second sections are drawn closer to one another by the coupling nut 18, the sealing disk 32 is compressed and expanded so as to fill all voids within the coupling port and the area surrounding the connecting pin 20 so as to create a weather-tight seal within the coupling port.

It will be appreciated by those of skill in the art that the compression washer 36 may be formed as an integral part of the connecting pin 20 rather than as a separate component for applying pressure to the sealing disk 32.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed:

1. A male splice adaptor comprising:

a tubular housing having a first section which is detachably coupled to a second section, said first section including an output port;

a connector pin disposed within said housing and extending outwardly from said output port;

a seal provided in said output port and configured such that said connector pin passes through said seal to extend from said output port, said seal including a pliable disk and a rigid disk;

retainer means associated with said first section for retaining said seal within said output port; and means associated with said connector pin for coacting with said retainer means in response to the coupling of said first section to said second section to distort said seal in a manner creating a weather-tight seal between said pin and said first section within said output port, said coacting means including a ridge defined about said connector pin, said ridge contacting an inwardly facing surface of said pliable disk, said ridge comprising a portion of said connector pin which is tapered inwardly from a predetermined diameter to a smaller diameter.

2. The splice adaptor of claim 1, wherein said retaining means comprises a curled edge portion of said tubular housing.

3. The splice adaptor of claim 1, wherein said retaining means comprises a plurality of retaining tabs disposed about the outer circumferential edge of said output port, said tabs contacting an outwardly facing surface of said rigid disk.

4. The splice adaptor of claim 1, wherein said first section is pulled inwardly along said connector pin as it is coupled to said second section so as to enable said coacting means to apply a force to said seal which is opposite that associated with said retaining means, thus causing said seal to expand within said output port.

5. A male splice adaptor comprising:

a tubular housing having a first section which is detachably coupled to a second section, said first section including an output port;

a connector pin disposed within said housing and extending outwardly from said output port;

a seal provided in said output port and configured such that said connector pin passes through said seal to extend from said output port, said seal including a pliable disk and a rigid disk;

retainer means associated with said first section for retaining said seal within said output port, said retaining means including a plurality of retaining tabs disposed about the outer circumferential edge of said output port, said tabs contacting an outwardly facing surface of said rigid disk; and means associated with said connector pin for coacting with said retainer means in response to the coupling of said first section to said second section to distort said seal in a manner creating a weather-tight seal between said pin and said first section within said output port.

6. The splice adaptor of claim 1, wherein said coacting means comprises a washer disposed about said connector pin, said washer contacting an inwardly facing surface of said pliable disk.

7. The splice adaptor of claim 1, wherein said first section is pulled inwardly along said connector pin as it is coupled to said second section so as to enable said coacting means to apply a force to said seal which is opposite that associated with said retaining means, thus causing said seal to expand within said output port.

8. The splice adaptor of claim 1, wherein said coacting means comprises a ridge defined about said connector pin, said ridge contacting an inwardly facing, surface of said pliable disk.

9. The splice adaptor of claim 8, wherein said ridge comprises a portion of said connector pin which is tapered inwardly from a predetermined diameter to a smaller diameter.

10. A male splice adaptor comprising:

a tubular housing having a first section which is detachably coupled to a second section, said first section including an output port;

a connector pin disposed within said housing and extending outwardly from said output port;

a seal provided in said output port and configured such that said connector pin passes through said seal to extend from said output port, said seal including a pliable disk and a rigid disk;

retainer means associated with said first section for retaining said seal within said output port, said retaining means including a curled edge portion of said tubular housing disposed about the outer circumferential edge of said output port, said curled edge portion contacting an outwardly facing surface of said rigid disk; and means associated with said connector pin for coacting with said retainer means in response to the coupling of said first section to said second section to distort said seal in a manner creating a weather-tight seal between said pin and said first section within said output port.

11. The splice adaptor of claim 10, wherein said coacting means comprises a washer disposed about said connector pin, said washer contacting an inwardly facing surface of said pliable disk.

12. The splice adaptor of claim 10, wherein said first section is pulled inwardly along said connector pin as it is coupled to said second section so as to enable said coacting means to apply a force to said seal which is opposite that associated with said retaining means, thus causing said seal to expand within said output port.

13. The splice adaptor of claim 10, wherein said first section is pulled inwardly along said connector pin as it is coupled to said second section so as to enable said coacting means to apply a force to said seal which is opposite that associated with said retaining means, thus causing said seal to expand within said output port.

14. The splice adaptor of claim 10, wherein said coacting means comprises a ridge defined about said connector pin, said ridge contacting an inwardly facing surface of said pliable disk.

15. The splice adaptor of claim 14, wherein said ridge comprises a portion of said connector pin which is tapered inwardly from a predetermined diameter to a smaller diameter.

16. A male splice adaptor comprising:

a tubular housing having first and second sections which are detachably coupled to one another, each of said sections including respective first and second output ports;

a connector pin disposed within said housing and extending at opposite ends outwardly from said first and second output ports;

first and second seals respectively provided in said first and second output ports and configured such that said connector pin passes through said seals to extend from said first and second output ports;

means associated with said output ports for retaining said seals within said output ports; and means associated with said connector pin for applying a force to said seals as said first and second sections are coupled to one another such that said seals are expanded so as to create a weather-tight seal within each of said output ports.

17. The splice adaptor of claim 16, wherein said first and second sections are pulled inwardly along said connector pin in response to being coupled to one another so as to enable said force application means to apply forces to said seals which are opposite that associated with said retaining means, thus causing said seals to expand within said output ports.

18. The splice adaptor of claim 16, wherein said seals respectively comprise pliable disks.

19. The splice adaptor of claim 18, wherein said seals further comprise rigid disks.

20. The splice adaptor of claim 19, wherein said force application means comprise first and second washers disposed about said connector pin, said washers contacting respective inwardly facing surfaces of said pliable disks.

21. The splice adaptor of claim 19, wherein said retaining means comprises curled edge portions respectively associated with said first and second sections of said tubular housing.

22. The splice adaptor of claim 19, wherein said retaining means comprises a plurality of retaining tabs disposed about the outer circumferential edges of said output ports, said tabs contacting respective outwardly facing surfaces of said rigid disks.

23. The splice adaptor of claim 19, wherein said force application means comprise first and second ridges defined about said connector pin, said ridges contacting respective inwardly facing surfaces of said pliable disks.

24. The splice adaptor of claim 23, wherein said ridges comprise portions of said connector pin which is tapered inwardly from a predetermined diameter to a smaller diameter.

* * * * *